US007300562B2

(12) United States Patent
Hu et al.

(10) Patent No.: US 7,300,562 B2
(45) Date of Patent: Nov. 27, 2007

(54) PLATINUM ALLOY USING ELECTROCHEMICAL DEPOSITION

(75) Inventors: Zhongmin Hu, Kalispell, MT (US); Thomas L. Ritzdorf, Big Fork, MT (US); Lyndon W. Graham, Hillsboro, OR (US)

(73) Assignee: Semitool, Inc., Kalispell, MT (US)

( * ) Notice: Subject to any disclaimer, the term of this patent is extended or adjusted under 35 U.S.C. 154(b) by 255 days.

(21) Appl. No.: 10/667,802

(22) Filed: Sep. 22, 2003

(65) Prior Publication Data

US 2004/0055895 A1 Mar. 25, 2004

Related U.S. Application Data

(63) Continuation-in-part of application No. 09/429,446, filed on Oct. 28, 1999, now abandoned.

(51) Int. Cl.
*C25D 3/56* (2006.01)

(52) U.S. Cl. ..... 205/257; 205/123

(58) Field of Classification Search ..... 205/257
See application file for complete search history.

(56) References Cited

U.S. PATENT DOCUMENTS

| | | | | |
|---|---|---|---|---|
| 3,963,523 | A | 6/1976 | Tanaka et al. | |
| 3,988,651 | A | 10/1976 | Hertz | |
| 4,192,729 | A | 3/1980 | Cancelleri et al. | |
| 4,243,532 | A | 1/1981 | Tsuda et al. | |
| 4,285,784 | A | 8/1981 | Flinn et al. | |
| 4,310,392 | A | 1/1982 | Kohl | |
| 4,358,352 | A | 11/1982 | Rhoda | |
| 4,376,018 | A * | 3/1983 | Kohl | 205/278 |
| 4,427,502 | A | 1/1984 | Abys | |
| 4,586,998 | A | 5/1986 | Wood | |
| 4,705,606 | A | 11/1987 | Young et al. | |
| 4,750,977 | A | 6/1988 | Marrese | |
| 4,878,990 | A | 11/1989 | Dugan et al. | |
| 4,895,739 | A | 1/1990 | Bladon | |
| 5,102,509 | A | 4/1992 | Albon et al. | |
| 5,207,883 | A | 5/1993 | Borrione et al. | |
| 5,227,001 | A | 7/1993 | Tamaki et al. | |
| 5,232,328 | A | 8/1993 | Owczarz et al. | |
| 5,256,274 | A | 10/1993 | Poris | |

(Continued)

FOREIGN PATENT DOCUMENTS

WO WO 98/02909 A1 1/1998

OTHER PUBLICATIONS

Abner Brenner, Electrodeposition of Alloys, Academic Press, New York, 1963, vol. I, pp. 611, 612, 617; vol. II, pp. 542-546.*

(Continued)

*Primary Examiner*—Roy King
*Assistant Examiner*—William T. Leader
(74) *Attorney, Agent, or Firm*—Christensen O'Connor Johnson Kindness PLLC

(57) ABSTRACT

The present invention is directed to methods and compositions for depositing a noble metal alloy onto a microelectronic workpiece. In one particular aspect of the invention, a platinum metal alloy is electrochemically deposited on a surface of the workpiece from an acidic plating composition. The plated compositions when combined with high-k dielectric material are useful in capacitor structures.

8 Claims, 1 Drawing Sheet

U.S. PATENT DOCUMENTS

| | | | |
|---|---|---|---|
| 5,310,475 | A | 5/1994 | Kitada et al. |
| 5,320,978 | A | 6/1994 | Hsu |
| 5,344,491 | A | 9/1994 | Katou |
| 5,403,468 | A | 4/1995 | Nakakoji et al. |
| 5,420,073 | A | 5/1995 | DiGiacomo et al. |
| 5,421,991 | A | 6/1995 | Yarita |
| 5,484,518 | A | 1/1996 | Goldberg |
| 5,494,560 | A | 2/1996 | Arimoto et al. |
| 5,529,680 | A | 6/1996 | Kitada et al. |
| 5,549,738 | A | 8/1996 | Kitada et al. |
| 5,549,808 | A | 8/1996 | Farooq et al. |
| 5,556,814 | A | 9/1996 | Inoue |
| 5,595,928 | A | 1/1997 | Lu et al. |
| 5,620,581 | A | 4/1997 | Ang |
| 5,620,583 | A | 4/1997 | Kuhn et al. |
| 5,685,970 | A | 11/1997 | Ameen et al. |
| 5,696,018 | A | 12/1997 | Summerfelt et al. |
| 5,729,054 | A | 3/1998 | Summerfelt et al. |
| 5,731,678 | A | 3/1998 | Zila et al. |
| 5,750,016 | A | 5/1998 | Moon |
| 5,779,929 | A | 7/1998 | Kim et al. |
| 5,789,320 | A | 8/1998 | Andricacos et al. |
| 5,972,192 | A | 10/1999 | Dubin et al. |
| 5,985,126 | A | 11/1999 | Bleck et al. |
| 6,074,544 | A | 6/2000 | Reid et al. |
| 6,077,412 | A | 6/2000 | Ting et al. |
| 6,080,291 | A | 6/2000 | Woodruff et al. |
| 6,107,186 | A | 8/2000 | Erb |
| 6,132,587 | A | 10/2000 | Jorne et al. |
| 6,140,241 | A | 10/2000 | Shue et al. |
| 6,174,425 | B1 | 1/2001 | Simpson et al. |
| 6,203,684 | B1 | 3/2001 | Taylor et al. |
| 6,236,079 | B1 | 5/2001 | Nitayama et al. |

OTHER PUBLICATIONS

Lowenheim, F.A., "Electroplating," McGraw-Hill Book Company, New York, 1979, pp. 12-13, and 416-423.

Kotecki, D.E., et al., "(Ba, Sr)$TiO_3$ Dielectrics for Future Stacked-Capacitor DRAM," *International Business Machines Journal of Research Development 43*(3):367-382, May 1999.

* cited by examiner

PLATINUM ALLOY USING ELECTROCHEMICAL DEPOSITION

CROSS-REFERENCE TO RELATED APPLICATION

This application is a continuation-in-part of U.S. patent application Ser. No. 09/429,446, filed on Oct. 28, 1999, now abandoned the priority of which is claimed under 35 U.S.C. § 120.

FIELD OF THE INVENTION

The present invention is directed to the electrochemical formation of a noble metal alloy on a surface of a microelectronic workpiece, such as a semiconductor wafer, useful in the manufacture of microelectronic devices and/or components. The present invention is also directed to the chemistry for electrochemical formation of a noble metal alloy on the microelectronic workpiece.

BACKGROUND OF THE INVENTION

Memory technologies employ dynamic random access memory (DRAM) and ferroelectric random access memory (FRAM) cells. These cells employ a large number of devices that are capable of holding a charge, such as capacitors. Generally, a capacitor has a set of electrodes separated by an insulator. Typically, many capacitors are required to provide useful quantities of storage capability. The amount of charge that can be stored on a capacitor is termed its capacitance. Capacitance is affected by the area of the conductive surfaces (i.e., the electrodes), the separation distance of the conductive surfaces, and the material separating the conductive surfaces (i.e., the insulator or dielectric). As DRAM or FRAM cell size restrictions become more stringent (i.e., smaller) because of the need for higher-density storage capability, the capacitance requirements for an individual capacitor are expected to remain the same. Therefore there is a need for RAM structures and materials capable of meeting the capacitance requirements while allowing for reduced cell size.

For a parallel plate capacitor with a dielectric, the capacitance is given by:

$$C = k\frac{\overset{o}{a}_o A}{d}$$

Wherein,
C=capacitance,
k=dielectric constant
d=plate separation (space enclosed),
A=plate area, and
$a^o{}_o$=permitivity of free space.

According to the equation, capacitance is proportional to the plate area and dielectric constant, but inversely proportional to the capacitor electrode spacing. These three variables have an effect on the work function and the leakage current, which are used to evaluate capacitor performance. Work function is the minimum level of energy needed to remove an electron from the Fermi level of a metal to infinity. *McGraw-Hill Dictionary of Scientific and Technical Terms,* $5^{th}$ ed. The work function and leakage current requirements must be adhered to when the spacing, dielectric constant, or area are changed.

The dielectric constant k is a property of any material. Traditionally, $SiO_2$ and $Si_3N_4$ materials have been used as dielectrics in microelectronic workpiece processing, but future generations of DRAM necessitate the use of high-k dielectric materials. High-k dielectric materials are presently being investigated for integration into DRAM devices.

High-k materials have an associated electron affinity greater than low-k materials. Electron affinity is defined to mean the work needed in removing an electron from a negative ion, thus restoring the neutrality of an atom or molecule. In theory, if the electron affinity of a dielectric is close to the work function of an electrode, it is easy for electrons to move from the metal into the non-metal. Electrode materials must be chosen so that the electrode work function is greater than the electron affinity of the dielectric otherwise, electrons migrate to the conduction band producing a net transport of charge, meaning current will bleed from the capacitor. This occurrence is termed leakage current. Therefore, future high-k dielectrics will require electrodes with large work functions.

Typically, platinum has been considered a suitable choice for capacitor electrodes because its inertness, resistance to oxygen diffusion, and high work function leads to low leakage current and a high breakdown voltage. Platinum is known to have a work function of 5.6 to 5.7 (eV). *(Ba, Sr) $TiO_3$ dielectrics for future stacked-capacitor DRAM, IBM Journal of Research and Development,* Vol. 43, No. 3, Kotecki et al. Electrochemically deposited platinum provides numerous advantages, for example, high conformality, a high deposition rate, and minimal platinum etching on patterned surfaces. Suitable methods and apparatus for electrochemically depositing platinum on a surface of a microelectronic workpiece have been described by the present inventors in U.S. patent application Ser. No. 09/429,446.

Despite the suitability of platinum as a material for capacitor electrodes, future generation capacitor designs employing high-K dielectric materials will require that electrodes be made from materials that exhibit a suitable resistivity, a work function even higher than platinum, and permeability to oxygen that is less than platinum.

It is believed that platinum alloys would be a suitable electrode material and exhibit a higher work function and a lower permeability to oxygen than platinum. Therefore, the need exists to develop plating compositions and methods of forming noble metal alloy features on the surface of a microelectronic workpiece.

SUMMARY OF THE INVENTION

Manufacturers of microelectronic workpieces will find the present invention useful owing to its ability to effectively deposit noble metal alloys and form structures such as electrodes for capacitors. Manufacturers will find the work function and oxygen permeability properties of noble metal alloys desirable in their quest to reduce the size of features such as capacitors. The present invention is directed to methods for forming noble metal alloys on the surface of a microelectronic workpiece and plating compositions from which noble metal alloys can be deposited. In one particular aspect of the invention, a platinum metal alloy is electrochemically deposited on a surface of a microelectronic workpiece.

In a further aspect of the present invention, an acidic plating composition for deposition of a noble metal alloy onto a surface of a microelectronic workpiece is provided. The composition includes species of a noble metal, an optional complexing agent capable of forming a complex with the noble metal, species of a second metal, and an acid. In one embodiment, the noble metal species is platinum (II).

In another aspect of the present invention, a method is provided for forming noble metal alloy features on the surface of a microelectronic workpiece. The method includes a step of contacting a workpiece surface with a plating composition including species of a noble metal and species of a second metal formed in accordance with the present invention. An anode contacting the plating composition and spaced from the workpiece surface is provided. The noble metal alloy is deposited onto the surface of the microelectronic workpiece by applying electroplating power between the workpiece surface and the anode.

The methods and plating compositions of the present invention provide numerous advantages to microelectronic manufacturers. For example, capacitor structures made using the methods and plating compositions of the present invention exhibit a current leakage that is up to three orders of magnitude less than that which is achievable with materials deposited using PVD or CVD techniques. Noble metal alloys, such as platinum alloys, provide a suitable barrier against oxidation of the underlying features. Furthermore, electrodeposition of noble metal alloys using the methods and plating compositions of the present invention provide high conformality and a high deposition rate for thin films. Alloyed features made according to the present invention can decrease the diffusivity of hydrogen and oxygen thereby enhancing the desirable electrical performance (such as capacitance) of structures including such alloyed features.

BRIEF DESCRIPTION OF THE DRAWINGS

The foregoing aspects and many of the advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
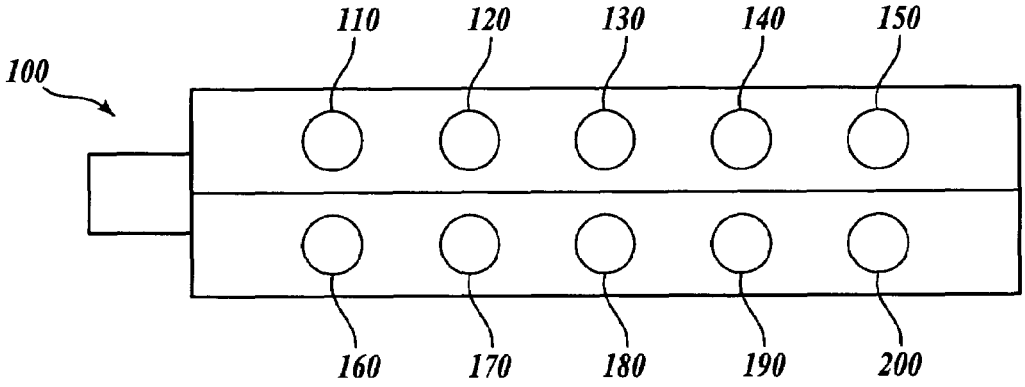
FIG. 1 is a schematic representation of a tool for electrolytically depositing a noble metal alloy onto a microelectronic workpiece in accordance with the present invention.

As used herein, the term "microelectronic workpiece" or "workpiece" is not limited to semiconductor wafers, but rather refers to workpieces having generally parallel planar first and second surfaces, that are relatively thin, including semiconductor wafers, ceramic workpieces, and other workpieces upon which microelectronic circuits or components, data storage elements or layers, and/or micromechanical elements are formed.

Species of a metal refers to ions or complexes of the metal.

Noble metal alloys formed using methods and plating compositions of the present invention, comprise noble metal alloys with the general formula Me-X. Without limitation, Me may be silver, gold, palladium, platinum, rhodium, iridium, rhenium, and osmium. X is a second metal, such as nickel, cobalt, lead, tin, copper, thallium, aluminum, bismuth, chromium, indium or molybdenum.

ECD PROCESS FOR DEPOSITION OF Me-X FEATURES

An electrochemical deposition process for depositing a noble metal alloy in accordance with the present invention, such as a platinum alloy, onto the surface of a workpiece, can be carried out using commercially available equipment, such as the LT210™ ECD system available from Semitool, Inc., of Kalispell, Mont., and described in PCT Application No. WO 98/02911, the disclosure of which is expressly incorporated herein by reference. Other suitable tools include those available from Semitool, Inc. under the trademarks PARAGON® and EQUINOX®.

In accordance with such method, the underlying workpiece material is wetted and cleaned using deionized water or acid and/or a surfactant solution. During this step, the wetting solution may be heated to the same temperature at which electroplating will occur.

The electroplating system is adjusted and/or programmed for the appropriate processing parameters to control the composition of the deposited alloy feature. This includes setting all or some of the following variables: (1) flow rate of solution containing species of noble metal (Me) and second metal (X); (3) plating composition pH; (4) plating composition temperature; (5) concentration of noble metal species in the plating composition; (6) concentration of the second metal X in the plating composition; (7) concentration of complexing agents in the plating composition; (8) current density or deposition potential; (9) wave form of electroplating power applied; and (10) the rotation rate of the workpiece. The adjustment and/or programming of these variables can take place either manually or using a programmable control system.

The surface of the workpiece that is to be plated is brought into contact with the noble metal alloy electroplating composition.

Full scale electroplating current can be applied for a duration necessary to achieve the desired depth of deposited alloy. The depth of the deposited alloy will be determined by the device application. Optionally, an initial low electroplating current is applied for a first predetermined period of time to initiate electroplating of the noble metal alloy on the surface of the workpiece. A low current initiation step allows for a slow buildup of the noble metal alloy. When the thickness of the deposited noble metal alloy has increased beyond a predetermined magnitude, the current (and plating rate) can be increased without stress cracking.

The workpiece is then disengaged from the plating composition and can be spun to remove any excess electroplating solution, followed by rinsing with deionized water and drying. The workpiece can optionally be subjected to a backside cleaning process to remove any backside contamination.

The pH of the plating composition used in an electroplating process carried out in accordance with the present invention should be chosen so that both metals Me and X and/or their complexes can be held in solution and deposited at a common cathodic potential. In the case of platinum alloy, satisfactory electroplating can be achieved when the plating composition is acidic, for example, in the range from about pH 0.5 to about pH 3.0. Compared to alkaline baths, acidic plating baths are generally not susceptible to carbonate buildup as a result of the absorption of atmospheric carbon dioxide which may adversely affect the quality of the deposited metals and bath life.

The temperature of the plating composition used in the electroplating process of the present invention can vary. At higher temperatures, less film stress is observed, while at lower temperatures more film stress is observed. In addition, at lower temperatures the current efficiency is lower compared to the current efficiency at higher temperatures. Suitable plating composition temperatures range from about 40° C. to 80° C.

The solution flow rate for the plating composition should be selected so that the desired plating rate can be maintained. Plating composition flow rates up to 5 gallons per minute can provide satisfactory results.

The concentration of noble metal Me in the plating composition can be varied over a wide range. The particular concentration of noble metal Me in the plating composition can be varied to affect the composition of the deposited alloy. In addition consideration can be given to the desired deposition rate. Raising the concentration of noble metal Me, and second metal X for that matter, enables a higher deposition rate. Noble metal concentrations in the range of 0.2 to 15 g/l in the plating solution can provide satisfactory results.

The concentration of the metal X in the plating composition can also be varied over a wide range depending in part upon the amount of metal that is desired in the deposited alloy. As discussed above with respect to noble metals, the concentration of the second metal X can be raised to enable a higher deposition rate or it can be lowered when lower deposition rates are desired. Metal X concentrations ranging from about 5 g/l to about 70 g/l are suitable.

The current density that is used in accordance with the present invention will depend upon the desired deposition rate and the need to limit the amount of hydrogen gas that evolves during the electroplating process. The formation of hydrogen gas is undesirable because it may be trapped in the plated film thereby resulting in stress cracking. Current densities ranging from about 10 $mA/cm^2$ to about 100 $mA/cm^2$ are suitable, depending on the metal concentration in the plating composition.

In the context of the exemplary Me-X alloys, platinum nickel or platinum-cobalt, in order to effectively deposit a platinum nickel alloy or a platinum cobalt alloy, the weight ratio of nickel or cobalt to platinum in the plating solution must provide an excess of the nickel or cobalt. For example, a weight ratio of nickel to platinum of at least 5:1 or greater or a cobalt to platinum weight ratio of 30:1 or greater is satisfactory. The particular weight ratio chosen will depend upon the desired composition of the plated alloy. If less platinum in the plated alloy is desired, the ratio of the second metal to platinum can be increased and vice versa. The foregoing weight ratios are for a plating composition that employs dinitritodiamineplatinum (II) as the source of platinum. If complexing agents are employed that further lower the deposition potential for platinum, it is likely that the weight ratio of second metal X to platinum can be reduced without adversely affecting the properties of the deposited alloy.

Similar plating processes, or ones with only slight modifications, using the particular plating bath required, can be used to plate other noble metal alloys Me-X. The foregoing processing steps may be implemented in a single fabrication tool having a plurality of similar processing stations and a programmable robot that transfers the workpieces between such stations as described below in more detail.

PLATING COMPOSITIONS

The components in a plating composition formed in accordance with the present invention depends upon the particular noble metal alloy that is to be deposited. The plating composition may be formulated from specific combinations of plating solutions with other adjuvants herein described, thus providing unique compositions. Plating compositions formed in accordance with the present invention include species of a noble metal (Me) to be deposited on the surface of the microelectronic workpiece. The bath also includes species of a second metal (X) to be deposited on the surface of the microelectronic workpiece, an acid, and optionally a complexing agent.

Examples of sources for noble metal species useful in plating compositions of the present invention include, without limitation, for plating gold, cyanide-based or sulfite-based solutions (such as Enthone-OMI Neutronex 309); for plating ruthenium, sulfonate, nitrosyl sulfamate or nitroso-based solutions (such as Technic's Ruthenium U, Englehard's Ru-7 and Ru-8, and LeaRonal's Decronal White 44 and Decronal Black 44); and for plating platinum, potassium hydroxide-based, ammonia-nitrite-based, nitrate-sulfate-based solutions (such as Englehard's Platinum A, Technic's Platinum S bath, Technic's Platinum TP or Enthone's Platanex III).

The choice of a particular source of noble metal species is partially dependent upon the particular plating process being used. For example, with respect to platinum, a potassium hydroxide-based solution, such as Englehard's Platinum A, is suited for use in an alkaline plating process, while an ammonia-nitrite-based solution (such as Platanex III) is suited for use in a photoresist template process. The source of the second metal X useful in plating compositions of the present invention, includes salts of the particular metal X. For example, for nickel, a nickel sulfamate may be used. For cobalt, cobalt sulfamate provides satisfactory results. Other suitable metal salts include sulfate, chloride, and methanesulfonate.

The plating compositions of the present invention also include an acid in order to control the pH within the desired ranges. Exemplary acids include sulfamic acid.

The metals that are to be deposited as an alloy onto the workpiece in accordance with the present invention are present in the plating compositions as a species of metal ions or complexed ions. Metal ions are reduced under process conditions that preferentially deposit the metals as metallized features relative to the surrounding field regions, so as to cover any exposed, raised or recessed, conductive features. Such compositions may advantageously include organic additives that either encourage deposition within the recessed or raised features (i.e., accelerators), or that suppress deposition of metal ions onto the surrounding field surface (i.e., suppressors). As used herein, the term organic additives is intended to encompass accelerators, also known as brighteners or enhancers, suppressors and also levelers.

Accelerators are typically small molecules which are believed to be preferentially adsorbed within the features to be metallized (without being limited by theory), to accelerate the deposition of metal ions locally at that feature. Suitable accelerators for use in the compositions of the present invention include water soluble salts of organic acids including mercapto or thiol functional groups, as well as other compounds that include the chemical structure S—R—S, wherein R is an alkyl or aryl moiety. Such accelerators which are suitable for use in the present invention include those disclosed in U.S. Pat. No. 5,223,118 to Sonnenberg et al., U.S. Pat. No. 4,673,469 to Beach et al., U.S. Pat. No. 4,555,315 to Barbieri et al., U.S. Pat. No.

4,376,685 to Watson, and U.S. Pat. No. 3,770,598 to Creutz, the disclosures of which are hereby expressly incorporated by reference.

Suppressor agents, which are typically large molecules that adsorb onto the substrate surface in the field area, are less adsorbed at recessed or raised metallized features. Suitable examples of suppressors include polyethylene glycols having molecular weights of approximately 3000-8000. Suitable suppressor agents are commercially available from sources such as Aldrich.

The plating solution may also include levelers or leveling agents, which are introduced into the plating solution to impart a higher degree of planarization of an electrochemically deposited metal, and in particular are often used in conjunction with suppressors and/or accelerators to counteract the tendency to build up overburdens over the recessed features. Such levelers include compounds including the chemical structure N—R—S, wherein R is an alkyl or aryl group, such as those disclosed in U.S. Pat. Nos. 5,223,118, 4,555,315, 4,376,685, and 3,770,598. Other examples of suitable levelers for use in the present invention include those disclosed in U.S. Pat. No. 6,024,857 to Reid, the disclosure of which is hereby expressly incorporated by reference, including: polyacrylic acid, polystyrene, polyvinyl alcohol, polyvinyl pyrrolidone, poly(methyl methacrylate), poly(ethylene oxide), poly(dimethylsiloxane) and derivatives, polyacrylamide-co-acrylic acid, poly(2-hydroxyethyl methacrylate), poly(sodium 4-styrene sulfonate) and maleic acid copolymers.

EXEMPLARY ECD APPARATUS

The electrochemical deposition of a noble metal alloy may be implemented in a wide range of electroplating reactor types. An integrated processing tool that incorporates one or more electroplating reactors that are particularly suitable for implementing the foregoing electrochemical deposition process is available from Semitool, Inc., of Kalispell, Mont. Such tools are sold under the brand names LT-210®, Paragon®, and Equinox® and are readily adapted to implement a wide range of electroplating processes used in the fabrication of microelectronic circuits and components. Advantageously, the reactors employed in these tools rotate a workpiece during the electrochemical deposition process, thereby enhancing the uniformity of the resulting film. To further enhance the quality of the resulting noble metal alloy, the electrochemical deposition reaction chamber(s) of these tools may be fitted with an ultrasonic generator that provides ultrasonic energy to the electroplating solution during the electrochemical deposition process to thereby enhance the desired characteristics of the resulting alloy feature.

In addition to electroplating reactors, such tools frequently include other ancillary processing chambers such as, for example, pre-wetting chambers, rinsing chambers, etc., that are used to perform other processes typically associated with electrochemical deposition. Semiconductor wafers, as well as other microelectronic workpieces, are processed in such tools in the reactors and are transferred between the processing stations, as well as between the processing stations and input/output stations, by a robotic transfer mechanism. The robotic transfer mechanism, the electroplating reactors and the plating recipes used therein, as well as the components of the processing chambers are all under control of one or more programmable processing units.

FIG. 1 is a schematic representation of a suitable tool 100 for electroplating noble metal alloy onto a microelectronic workpiece, such as a semiconductor wafer. The tool 100 includes a plurality of workstations for carrying out prewet, spin/rinse/dry and plating steps. The particular arrangement for the various workstations can vary; however, an exemplary layout is illustrated in FIG. 1. In FIG. 1, workstations 140 and 150 are spray chambers capable of applying acid, base, or any other kind of salt solution to the workpiece surface. Workstations 140 and 150 are commonly referred to as spin/rinse/dry chambers. Chambers 140 and 150 can also be used to pretreat the workpieces, for example, by prewetting them prior to further processing. Workstations 160, 170, 180, 190, and 200 are electroplating reactors for electrolytically depositing noble metal alloys in accordance with the present invention. Workstations 110, 120, and 130 are additional spin/rinse/dry chambers capable of post-deposition processing such as cleaning and drying. In an exemplary sequence, a workpiece is prewetted at station 140 or 150 followed by a water rinse in the same workstation. The workpiece is then transferred to one of the electrolytic noble metal alloy deposition chambers 160, 170, 180, 190 or 200 where deposition of the noble metal alloy proceeds. Following the deposition, the workpiece is transferred to workstation 110, 120, or 130, where it is rinsed and dried. Though not illustrated, the workpiece is delivered from workstation to workstation through a shuttle provided with the tool.

Figure 2:
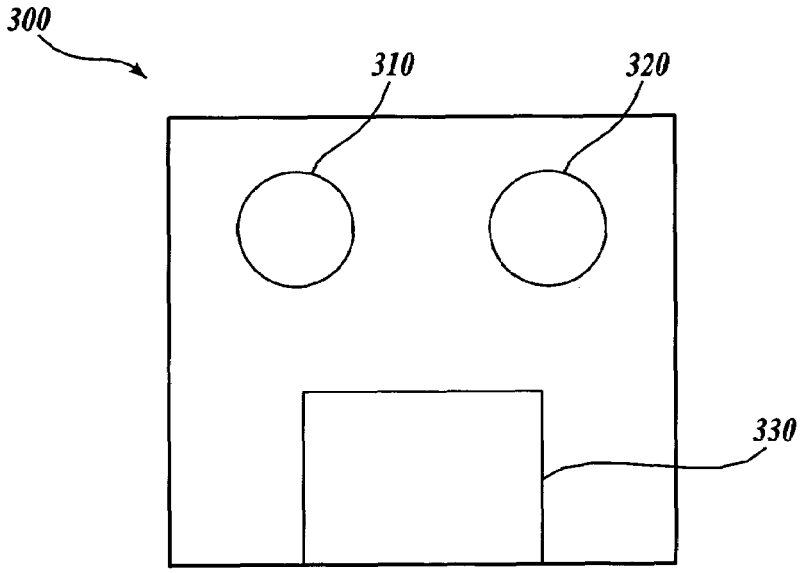
FIG. 2 is a schematic representation of another tool for electrolytically depositing a noble metal alloy onto a microelectronic workpiece in accordance with the present invention.

Referring to FIG. 2, another tool 300 includes workstations 310 and 320 capable of receiving workpieces from workpiece cassette 330. The workpieces are delivered from the workpiece cassette 330 to chambers 310 or 320 and delivered between chambers 310 and 320 by a robotic arm (not shown). In tool 300, workstation 310 is a spin/rinse/dry chamber capable of applying fluid media to the workpiece as described above. Workstation 320 is a reactor for the electrolytic deposition of a noble metal alloy. An exemplary process sequence using this tool involves prewetting of the workpiece in spin/rinse/dry chamber 310, followed by a deionized water rinse. The workpiece is then transferred from workstation 310 to reactor 320 where electrolytic deposition of a noble metal alloy takes place. The workpiece is then returned to workstation 310 where it is rinsed and dried.

Other apparatus suitable for carrying out the present invention are described in U.S. patent application Ser. No. 09/429,446, which is herein expressly incorporated by reference in its entirety.

The following examples illustrate methods and plating compositions for the deposition of platinum nickel and platinum cobalt alloys in accordance with the present invention. It should be understood that the examples are illustrative only and that other noble metal alloys can be deposited in accordance with the present invention.

EXAMPLE 1

Pt—Ni Alloy

Pt—Ni alloy was deposited at the beaker level onto a workpiece having platinum seed layers from an acidic aqueous solution of platinum complex and nickel salt in the presence of sulfamic acid ($NH_2SO_3H$). the platinum complex used was dinitritodiamineplatinum (II), i.e., $Pt(NH_3)_2(NO_2)_2$. The nickel salt used was nickel(II) sulfamate. Solution pH was adjusted to 1.2±0.2 and controlled with sulfamic acid. Current density was 20 mA/cm$^2$. Bath temperature was 70° C.

When the molar ratio of nickel to platinum in solution was controlled to be 20/1 (by weight Ni/Pt=6/1), a 90/10 Pt—Ni (by weight) alloy was obtained on the platinum seed layers. Metal content in the deposited alloy was determined with energy-dispersive spectrometry (EDS).

EXAMPLE 2

Pt—Co Alloy

Pt—Co alloy was deposited at the beaker level onto a workpiece having platinum seed layers from an acidic aqueous solution of platinum(II) complex and cobalt(II) sulfate. The platinum complex used was dinitritodiamine-platinum(II), i.e., $Pt(NH_3)_2(NO_2)_2$. Solution pH was adjusted to 1.2±0.2 and controlled with sulfamic acid ($NH_2SO_3H$). Current density was 20 mA/cm$^2$ and bath temperature was 70° C. The composition of the deposits was determined using EDS.

A deposit having a composition of 95% wt % Pt and 5 wt % Co, was achieved using a plating composition with Co/Pt molar ratio of 100/1 (by weight Co/Pt=30/1).

The foregoing examples illustrate plating compositions formed in accordance with the present invention that are useful for electroplating noble metal alloys in accordance with the present invention. The examples describe platinum nickel and platinum cobalt alloys. Other noble metal alloys (Me-X) can be deposited in accordance with the present invention. The noble metal alloys deposited in accordance with the present invention are useful as metallized features on the surfaces of microelectronic workpieces. Particular applicability includes the use of such noble metal alloys in DRAM and FRAM cells employing high-k dielectric materials.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for depositing a platinum-metal alloy onto a surface of a microelectronic workpiece, the method comprising the steps of:

contacting the surface of the workpiece with an acidic bath comprising species of platinum to be deposited on the surface of the microelectronic workpiece, species of a second metal selected from nickel, cobalt, lead, and tin to be deposited on the surface of the microelectronic workpiece, and an acid, pH of the acidic bath ranging from about 0.5 to 3.0;

providing an anode spaced from the surface of the microelectronic workpiece in contact with the acidic bath;

applying electroplating power between the surface of the microelectronic workpiece and the anode; and depositing the platinum and the second metal onto the surface of the microelectronic workpiece, the amount of platinum deposited by weight being greater than the amount of the second metal deposited by weight.

2. The method of claim 1, wherein the weight ratio of the second metal to platinum in the acidic bath is greater than or equal to 5:1.

3. The method of claim 1, wherein the platinum concentration ranges from about 1.0 g/L to 15 g/L.

4. The method of claim 1, wherein the concentration of the second metaranges from about 5 g/L to 70 g/L.

5. The method of claim 1, wherein the acid is sulfamic acid.

6. A method of claim 1, wherein the acidic bath is at a temperature between about 40° C. and 80° C.

7. The method of claim 1, wherein the current density of the electroplating power ranges between about 10-100 mA/cm$^2$.

8. The method of claim 1, wherein the acidic bath is at a temperature of about 75 C±5 C.

* * * * *

UNITED STATES PATENT AND TRADEMARK OFFICE

CERTIFICATE OF CORRECTION

PATENT NO. : 7,300,562 B2
APPLICATION NO. : 10/667802
DATED : November 27, 2007
INVENTOR(S) : Z. Hu et al.

It is certified that error appears in the above-identified patent and that said Letters Patent is hereby corrected as shown below:

| COLUMN | LINE | |
|---|---|---|
| 10 (Claim 4, line 2) | 27 | "metaranges" should read --metal ranges-- |
| 10 (Claim 8, line 2) | 36 | "75" should read --75°-- |
| 10 (Claim 8, line 2) | 36 | "C±5" should read --C±5°-- |

Signed and Sealed this

Twenty Second Day of April, 2008

JON W. DUDAS
*Director of the United States Patent and Trademark Office*